United States Patent [19]

Delgado et al.

[11] 3,976,009

[45] Aug. 24, 1976

[54] COMPOSITE CAST STRUCTURE AND PROCESS FOR MANUFACTURE OF SAME

[76] Inventors: Manuel M. Delgado; Paul A. Delgado, both of 12624 Ocaso, La Mirada, Calif. 90638

[22] Filed: Apr. 24, 1974

[21] Appl. No.: 463,534

[52] U.S. Cl. ..... 102/7.6; 102/92.7

[51] Int. Cl.[2] ..... F42B 25/18

[58] Field of Search ..... 102/2, 7.6, 49.1, 49.2, 102/92.2, 92.3, 92.7, 92.1

[56] References Cited

UNITED STATES PATENTS

| | | | |
|---|---|---|---|
| 1,350,828 | 8/1920 | Murray, Jr. et al. | 102/92.2 |
| 2,821,923 | 2/1958 | Alderson | 102/49.1 |
| 3,085,509 | 4/1963 | Brandt | 102/92.7 |
| 3,440,963 | 4/1969 | DeLuca | 102/92.7 |

*Primary Examiner*—Verlin R. Pendegrass

[57] ABSTRACT

Disclosed is a composite metal article and embodiment of a practice bomb used in the training of pilots. It comprises a body and fin structure having a predetermined center of gravity and aerodynamic design. The composite structure provides both the aerodynamic properties and physical characteristics equivalent to the prior art devices but with significant reduced costs and additionally manufacture which results in significantly less air pollution in the casting process. The process involves casting the body within a thin walled shell which becomes the outer surface of the composite body.

10 Claims, 6 Drawing Figures

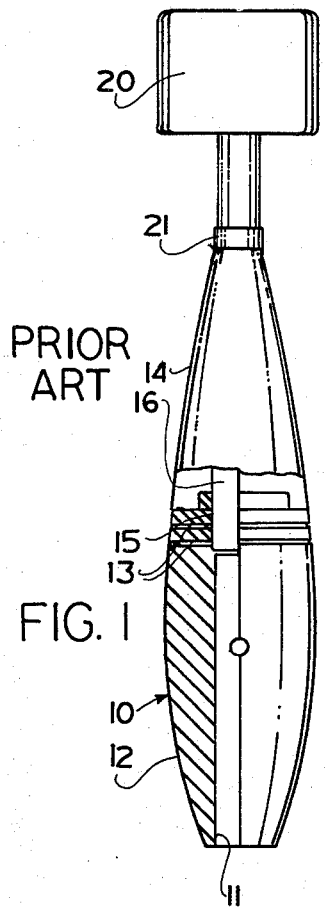
FIG. 1
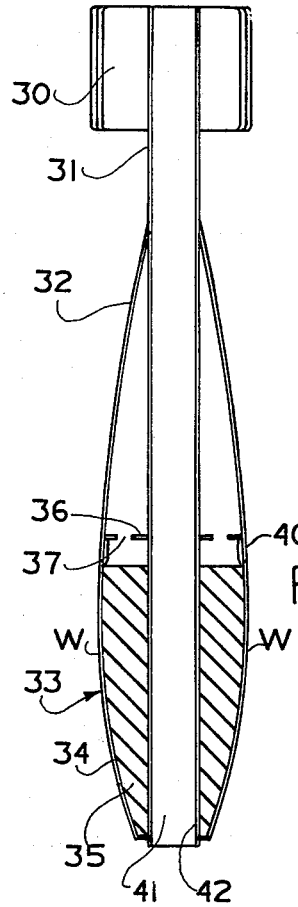
FIG. 2
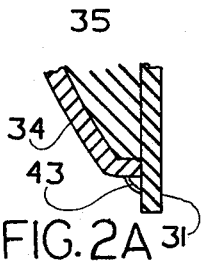
FIG. 2A
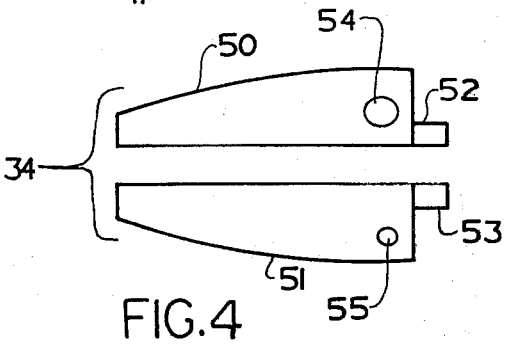
FIG. 4
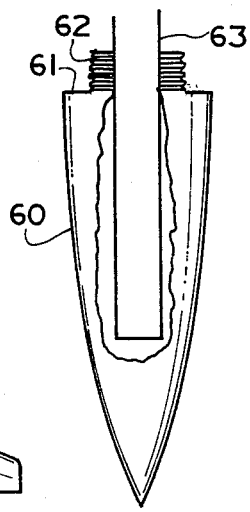
FIG. 3
FIG. 5
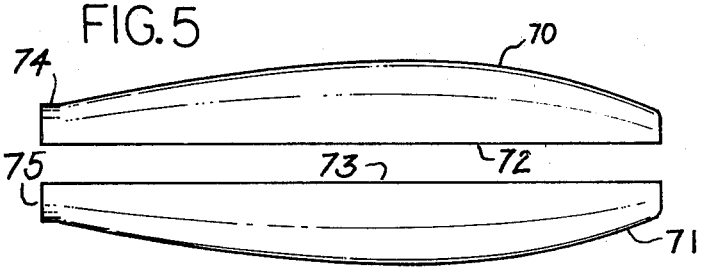

COMPOSITE CAST STRUCTURE AND PROCESS FOR MANUFACTURE OF SAME

BACKGROUND OF THE INVENTION

Heretofore, cast practice aerial bombs have been produced from grey iron castings produced in a foundry employing sand molds and a conventional resin bonded core. In such production, an elongated generally teardrop shape body has been produced with an internal axial opening resulting from the presence of a core within the sand mold and followed by an extensive machining operation to produce the ultimate aerodynamic shape. In order to minimize voids in the casting operation as characteristic in foundries, it has been necessary to cast each bomb with significant riser or sprue extending upward out of the mold and then subsequently removing said riser or sprue by cutting or machining operation. Often the total volume of the cast metal in the sprue or riser approximates that of the cast body. This has resulted in the past in a necessary melting of far greater quantities of cast material than actually form a part of the finished product followed by reclamation of the sprue or riser.

In order to cast the actual opening rather than machining a substantial diameter hole, the use of a consumable core made up of resin bonded sand has been the practice, in the process of casting the resin bonded core means in the required space, until the metal hardens and is subsequently removed. At molding temperatures, the resin is vaporized and adds to the total air contamination. The need for melting and casting far greater volume than the finished product plus the vaporization of mold core binder results in unnecessary air pollution. Thereafter, the elimination of excess sand plus the necessary machining of the external plus the internal surfaces of the casting produces greater use of energy plus contamination as well.

Likewise, it has often been found towards the end of the steps of manufacturing of the cast molding, a soft spor or void appears in the cast metal resulting in a rejection.

BRIEF STATEMENT OF THE INVENTION

In accordance with this invention, a modified improved design of cast structures has been evolved and an improved process for reducing the cost and pollution has been developed.

In the modified improved structure in accordance with this invention, it is found, again involves a main body portion and an afterbody carrying a fin. The main body is now made up of a shell having the prescribed aerodynamic properties and including a tubular metal insert extending therethrough and constituting the fin support member. The shell member includes at least one opening at its upper end through which molten iron is poured in to substantially fill the cavity and to harden in virtual bonded engagement with the surfaces defining the shell. The afterbody includes a conical section mating with an upper section of the shell suitable for spot or continuous welding to join the two parts. Alignment of the afterbody is obtained by its encircling relationship with the elongated tube defining the axis of the entire bomb.

An alternate embodiment, the shell defining the main body portion of the structure is made up of a pair of clam shell appearing longitudinal halves designed to be assembled together as by welding.

Another alternate embodiment of this invention is that the upper or rear end of the shell member includes integral roll formed threads for engagement with the afterbody or fin structure.

BRIEF DESCRIPTION OF THE DRAWING

These features may be more clearly understood from the following detailed description and by reference to the drawing in which:

FIG. 1 is a vertical elevational view, partly in section, of a practice bomb of the prior art design;

FIG. 2 is a comparable vertical elevational view partly in section of a practice bomb, manufactured in accordance with this invention;

FIG. 2*a* is an enlarged fragmentary sectional view of a portion of the assembly of FIG. 2;

FIG. 3 is a vertical sectional view of an alternate embodiment of this invention; and FIG. 4 is an exploded view of a pair of clam shell like halves constituting an alternate embodiment of a shall portion of this invention, and FIG. 5 is a side elevational view of an alternate embodiment of the shell portion of this invention.

DETAILED DESCRIPTION OF THE INVENTION

Now referring to FIG. 1, a typical practice bomb of the type which has been in use for several years is disclosed herein. It includes a body portion 10 comprising a machined metal casting 10 having an axial opening 11 therethrough and an external aerodynamic shape surface 12. At the upper end thereof, there are a pair of annular grooves 13 used to secure an afterbody 14 to the main body 10 by roll forming technique. The body 10 also includes a counterbore 15 into which a tube 16 extends in engagement with the body 10. The tube 16 carries the fin assembly 20 which is accurately positioned with respect to the body 10 by the counter bore 15 in the casting, and an integral collar portion 21 of the after body 14. The central opening 11 carries suitable detonators for visible powder charges or other mechanisms necessary for the particular operation of the bomb. As is readily apparent from an examination of the drawing of FIG. 1, each of the parts, the body 10, the afterbody 14, the tube 16 and the fins 20 are produced as individual parts and assembled to provide the completed bomb. The body 10 is produced by sand casting an approximate shape including a core center opening 11 in accordance with traditional foundry practice. Thereafter, it is machined to provide the correct internal diameter opening 11, the external aerodynamic surface 12, the grooves 13 and the counter bore 15 for the tube 16.

As produced in this traditional manner, the shell body 10 is cast in a sand mold with a resin bonded sand core in the appropriate opening in the sand mold such as to produce the rough opening 11. An external riser and or sprue, which of course are removed, extends upward above the mold casting. The body 10 is cast, for example of cast iron, the typical operation of which results in significant gaseous matter, mainly the decomposition products of the core resins as well as steam and other foreign material vaporized in the casting process, emitted through the riser during the casting process. After completion of casting, the sprue and risers are cut off, the opening 11 machined, the aerodynamics surface 12 machined as well as the grooves machined, producing additional loss of material in formation of chips. Where the casting, as is common occurance, includes an internal void or defect, that defect may affect the center of gravity or produce an external surface defect, and the casting must be scrapped.

The tube 16, of course, is produced from tubular material merely by cutting to length and the afterbody 14 is produced either by spinning, drawing or roll forming followed by welding. Altogether, a major element of cost is the cast body despite the low cost in theory of castings.

Now referring to FIG. 2, it is apparent that the external shape and dimensions of the practice bomb, in accordance with this invention, appears to be identical with that of the prior art. It includes an identical fin assembly 30, supported on the tube 31 which extends through an afterbody 32 which joins a main body 33. The main body portion 33 actually is a composite made up of an external shell 43 filled with cast metal 35. This shell includes an upper closure portion 36 having one or more openings 37 therethrough. The afterbody 32 is secured to the shell 34 as by slipfit or welding at the throat region 21 of the afterbody 32. It should be noted that of significant importance is the fact that the central opening 41, in accordance with this embodiment, is defined by the inner wall 42 of the tube 31. This inner wall has sufficiently close tolerances that no machining operation is required to define the cylindrical cavity in the bomb body at the completion.

Now referring to FIG. 2*a*, a typical joint in the sheet metal assembly is apparent at the nose of the bomb. There the shell 34 joins the lower region of the tube 31 and is welded thereto at 43. The cavity defined by a shell 34 and tube 31 is filled with cast metal which develops a near bonded relationship to both the tube and the shell 34. Upon cooling and complete manufacture of the bomb body, even a sectioning of the composite assembly shows a barely distinguishable interface between the shell 34 and the cast body 35. To all intents and purposes, it is a single unitary structure after manufacture in accordance with this invention.

In the embodiments shown in FIGS. 2 and 2*a*, the shell 34 may be produced from a pair of spun or deep drawn halves having an annular butt weld in the region indicated by the letter "W" in FIG. 2. This method of assembling two cup parts together by butt welding is well known in the art. The other modes of manufacture of the shell are possible. One particular form appears in FIG. 4. In this case, the shell 34 is made up of a pair of clam shell shaped stamped parts 50 and 51 which mate along longitudinal lines and may be welded together to provide a pair of longitudinal seams. In this embodiment, a shell may also easily be formed to have a reduced neck portion 52 and 53 which are joined together to form a cylindrical afterbody mounting region. Also, the clam shell halves 50 and 51 may be elongated and include the tapered afterbody as an integral portion thereby eliminating the afterbody core as a separate piece. Preferably, in this embodiment, again filling holes are present. An alternate position for filling holes is illustrated in FIG. 4 as well. In this case, the hole 54 is placed in the side wall adjacent to the upper end of the part 50. The opening 54 and other possible gas releasing opening 55 cooperate during the casting phase of manufacture with opening 54 used as a filling hole for molten metal and 55 for allowing any gaseous materials to exit from the closed assembly. Positioned as shown in the drawing of the opening 54 and 55 are covered by the conical afterbody section of the type 32 shown in FIG. 2. Therefore, these openings are available for use during the casting step and covered later without adverse effect upon the aerodynamics of the completed bomb.

Another modification of the structure in accordance with this invention is apparent in FIG. 3. In that case, the shell is deep drawn into a conventional ogive shape and includes an annular return portion 61 and a threaded neck portion 62 used to join the casing portion 60 to the afterbody by threads. Being tubular in shape, the threads 62 may be roll formed in place in a manner well known in the art and one which is significantly less expensive than machining. Again, a central tube 63 is illustrated although thus tube may or may not be required depending upon the particular application of the assembly. The return surface 61 includes the necessary filling and the relief holes.

A further simplification and reduction of parts is possible in carrying out this invention as may be seen in FIG. 5. In this embodiment, a pair of shell like members 70 and 71 define the entire exterior surface of both the body and afterbody portions of the practice bomb or composite structure. The two halves 70 and 71 may be joined at their adjacent edges 72 and 73 by welding or other means to define a substantially closed body. The body may have an axial opening similar to opening 41 of FIG. 2 or may be closed. The aft end of the parts 70 and 71 each include semi-cylindrical portions 74 and 75 suitable for engaging the outer surface of a tail fin mounting tube similar to tube 31 of FIG. 2 and unshown in FIG. 5. In any event the configuration of FIG. 5 eliminates the separate afterbody portion and also the need for filling holes similar to opening 37 of FIG. 2 and holes 54 and 55 of FIG. 4. Filling of the cast body may be accomplished through the cylindrical opening defined by the semi-cylindrical portions 74 and 75.

PROCESS OF MANUFACTURE

In carrying out this invention, the following steps are used:

1. Sheet metal parts are roll formed, drawn or stamped to meet the configurations required,
2. Body casing is formed and or welded and perforated as required.
3. Internal tube is welded to the casing at the ends thereof;
4. The casing is filled with molten metal at a temperature sufficient to soften, expand and bond the surfaces thereof to the molten metal;
5. Afterbody, if separate, is slipped over the tube and welded thereto as well as to the body shell.

Optional steps include the welding of threaded or other inserts into the shell prior to casting to avoid subsequent machining steps or fin attachment.

We have also found that the optimum bond between the casing and cast filling is achieved when the molten filling materials such as cast iron, is at the melted temperature in the range of 3000° F. to 2000° F. and poured while at a temperature range of 2400°F to 1700°F. The actual temperatures are adjusted depending on the metal thickness section of the cast body and the shell material and thickness. Typical cast body sections are from ½ to 4 inches and the shell is of 1/32 to ⅛ inch 1010 or 1020 ASTM cold rolled steel. The pour temperature is sufficient to raise the temperature of the shell virtually instantaneously to the temperature of the molten metal and to soften it to an extent and allowing for it expansion slightly. The entire assembly becomes cherry red and then cools and contracts as a unitary body. The end result is a composite body requiring little or no machining and one having the same weight characteristics as a cast and machined assemblage. Little or no machining operations are required on a cast body or shell. The use of the shell as the mold greatly reduces the time and pollutant activity involved in production and problems in accordance with this invention. The total melt need only be slightly greater than the amount of metal introduced into the casing and no sprue elimination is required. A void typically is left in the top of the casing although the filling of the entire casing up to the holes may be desirable under certain circumstances.

The above described embodiments of this invention are merely descriptive of its principles and are not to be considered limiting. The scope of this invention instead shall be determined from the scope of the following claims including their equivalents.

What is claimed is:

1. A composite cast projectile comprising an outer shell of sheet metal formed to conform with the required exterior shape of the finished projectile nose portion;

a tube extending through the shell and second thereto at one end thereof;

said tube and shell defining an internal cavity having a closed bottom;

at least one opening through said shell or tube communicating with said cavity;

cast metal substantially filling said cavity and in cast in place engagement with the walls of said shell and tube defining said cavity.

2. The combination in accordance with claim 1 wherein said tube is mounted coaxially within said shell thereby defining with said shell an annular shaped cavity for said cast filling and defining the longitudinal axis of the assemblage.

3. The combination in accordance with claim 2 including a frusto conical tubular section having its larger end mating with one end of said shell and its smaller end mating with said tube to define a continuous exterior configuration for said projectile.

4. The combination in accordance with claim 1 wherein said shell comprises a pair of butted cup members in welded engagement at the lips thereof to form an enclosing continuation of the shell surface.

5. The combination in accordance with claim 1 wherein said shell comprises a pair of longitudinally extending shell halves defining said shell casing.

6. An aerodynamic body comprising:

a body portion including an outer metal shell defining the aerodynamic surfaces of the nose and body portions of said shell;

a tubular member secured to said outer shell at the nose portion of said outer shell and extending beyond the opposite end of said outer shell;

a metal filling within said outer shell in engagement with said outer shell and said tubular member;

means defining an afterbody encompassing said tubular member and engaging said shell to provide an extension therefore, and;

fins secured to said tubular member.

7. An aerodynamic body in accordance with claim 6 wherein said outer shell includes at least one opening through which said metal filling mahy be introduced when in molten form.

8. The combination in accordance with claim 7 wherein said means defining an afterbody covers said opening.

9. The combination in accordance with claim 6 wherein said outer shell and metal filling are in bonded engagement.

10. The combination in accordance with claim 6 wherein said outer shell includes a reduced diameter rear portion opposite said nose portion;

said reduced diameter portion including integral threads therein.

* * * * *